US005595244A

United States Patent [19]

Roberts

[11] Patent Number: 5,595,244

[45] Date of Patent: Jan. 21, 1997

[54] HYDRAULIC JAR

[75] Inventor: Billy J. Roberts, Houston, Tex.

[73] Assignee: Houston Engineers, Inc., Houston, Tex.

[21] Appl. No.: 505,908

[22] Filed: Jul. 24, 1995

Related U.S. Application Data

[63] Continuation-in-part of Ser. No. 187,708, Jan. 27, 1994, Pat. No. 5,447,196.

[51] Int. Cl.[6] ..... E21B 31/107; E21B 4/14

[52] U.S. Cl. ..... 166/178; 175/296; 175/321

[58] Field of Search ..... 166/178; 175/296, 175/299, 321

[56] References Cited

U.S. PATENT DOCUMENTS

| | | |
|---|---|---|
| 3,735,827 | 5/1973 | Berryman . |
| 3,797,591 | 3/1974 | Berryman . |
| 4,109,736 | 8/1978 | Webb et al. . |
| 4,200,158 | 4/1980 | Perkins . |
| 4,226,289 | 10/1980 | Webb et al. . |
| 4,361,195 | 11/1982 | Evans . |
| 4,456,081 | 6/1984 | Newman . |
| 4,844,157 | 7/1989 | Taylor . |
| 4,844,183 | 7/1989 | Evans . |
| 5,007,479 | 4/1991 | Pleasants et al. . |
| 5,033,557 | 7/1991 | Askew . |
| 5,086,853 | 2/1992 | Evans . |
| 5,174,393 | 12/1992 | Roberts et al. . |
| 5,318,139 | 6/1994 | Evans . |
| 5,447,196 | 9/1995 | Roberts . |

*Primary Examiner*—Frank Tsay
*Attorney, Agent, or Firm*—Vaden, Eickenroht & Thompson, L.L.P.

[57] ABSTRACT

There is disclosed a single-acting hydraulic jar having upper and lower detent pressure chambers having upper and lower restrictions, respectively, formed on the inner diameter of its outer tubular member and through which upper and lower detent means carried about the outer diameter of the inner tubular member may be moved in order to impart an up jar.

1 Claim, 4 Drawing Sheets

Figure 1A:
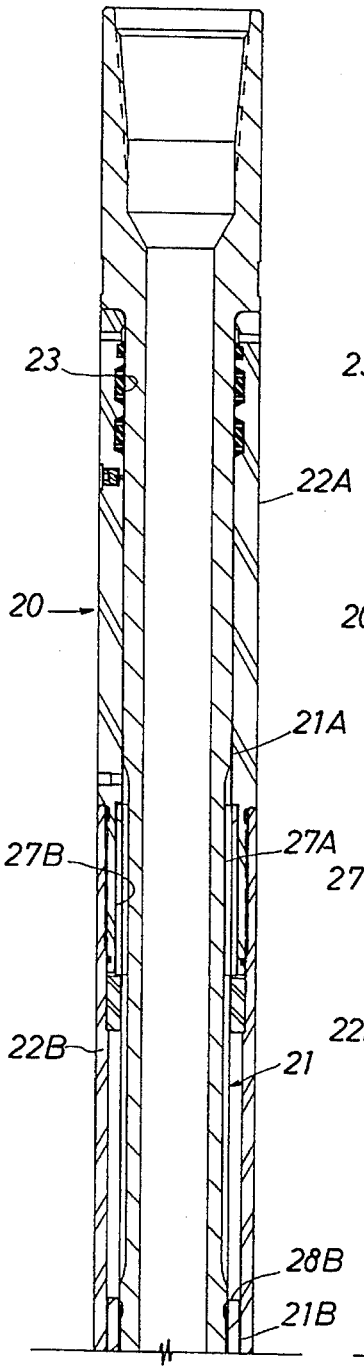

FIG. 4
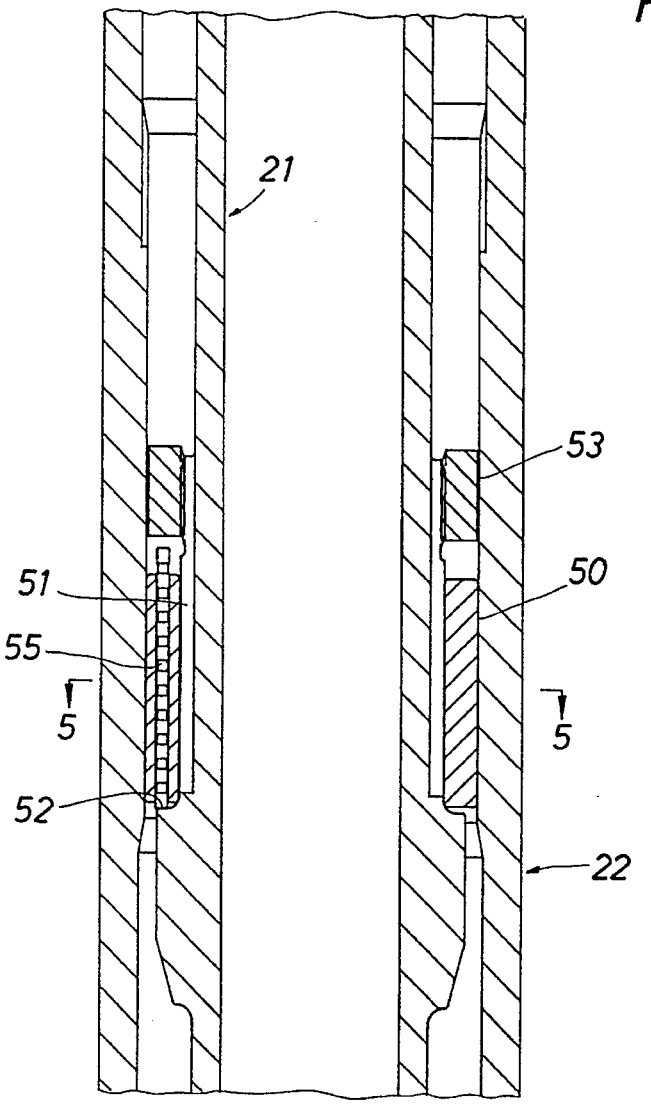
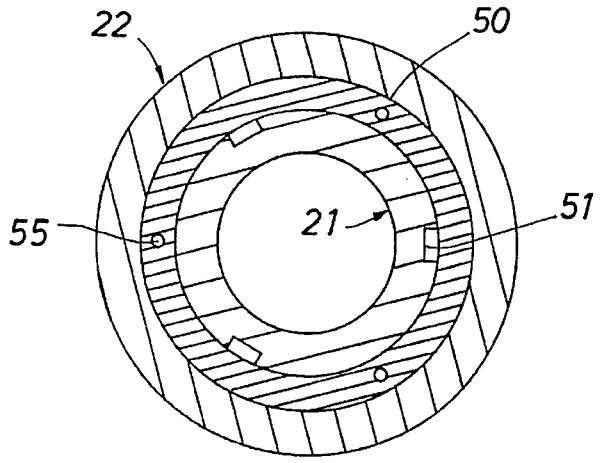
FIG. 5

HYDRAULIC JAR

This application is a continuation-in-part of application, U.S. Ser. No. 08/187,708, filed Jan. 27, 1994, and entitled "Hydraulic Jar" now U.S. Pat. No. 5,447,196.

This invention relates generally to a tool for use in imparting a jar to an object stuck in a well bore, and, more particularly, to improvements in an hydraulic jar especially well suited for imparting a one way jar, preferably up, to a "fish" stick in the well bore.

As well known in the art, a conventional hydraulic jar, whether for use during a fishing or a drilling operation, comprises a pair of telescopically arranged, tubular members, one for connection to the object and the other to a pipe string which may be raised and lowered within the well bore. More particularly, the members are circumferentially spaced apart to form an annular space between them with one member having a cylindrical surface which forms a restriction within the space and the other carrying detent means which fits closely within the restriction so as to retard its movement therethrough during movement of the one member with the pipe string in one longitudinal direction. The tubular members also have oppositely facing shoulders which are adapted to engage as the detent means moves out of the restriction so as to impart an up or down jar to the object which is stuck in the well bore.

More particularly, the outer member is ported to connect the annulus with the well bore, and a piston is sealably slidable between the members within the space to separate the port from a chamber therein which contains hydraulic fluid in which the detent means is disposed so as to restrict flow within the chamber and thus store energy in the string which is released as the detent means moves out of the restriction. This port, of course, equalizes the fluid pressure within the jar and well fluid in the annulus to facilitate raising and lowering of the jar within the well bore, as well as separating the hydraulic fluid from the well fluid to avoid contamination.

Additionally, jars of this type ordinarily have so-called "drive" sections which permit them to transmit torque from the pipe string to the object in the well bore. Conventionally, this comprises rollers or drive pins carried by one member for fitting within elongate grooves in the other.

When designed primarily for use in drilling operations, the jar is preferably of a double acting type wherein the detent means is of such construction that its movement is retarded as the pipe string is raised or lowered, whereby a down or up jar may be imparted to the object in the well bore through additional oppositely facing shoulders on the members. As shown in the aforementioned patent application, the detent means of the jar may be of such construction as to permit it to move through a single restriction in a single pressure chamber, thereby enabling the jar to be of considerably shorter length and thus less cost than conventional double acting jars.

Due to the fact that it is designed to impart a jar in only one direction—preferably up, which is normally sufficient in a fishing operation—the jar of the present invention may be even shorter and less expensive. In addition, since the torque requirements of a fishing jar are ordinarily less than that of a drilling jar, its drive section may be of simpler and less expensive construction.

As recognized in the aforementioned patent application, there is also a need in the industry, particularly as wells are drilled to greater depths, to be able to apply greater loads to an hydraulic jar without exceeding its burst strength. This would enable the operator of the tool to obtain a better balance between burst of the outer housing and collapse of the inner mandrel, which, of course, is crucial because, if a jar is over-pulled or pushed, it is better for the cylinder to burst than for the mandrel to collapse. Thus, in the latter case, it would be impossible to enter the inner diameter of the pipe string with free point indicators, string shots, etc.

However, as further recognized in the aforementioned application, due to the rigid constraints of space within the well bore, it is not practical to merely increase the diameter of the jar and thus the effective pressure-responsive areas in its fluid chambers. Consequently, it was the purpose of my prior invention to provide an improved double acting jar in which the pressure in each of a pair of pressure chambers may be reduced by fifty percent or more for any given load without increasing its outer diameter or substantially increasing its cost. It is the object of this invention to provide a one way, preferably up, jar suitable for fishing purposes and of such construction as to accomplish the same purpose.

These and other objects are accomplished, in accordance with the illustrated embodiment of the invention, by an hydraulic jar having means sealing between upper, lower and intermediate equal diameter portions of the tubular members, an upper piston ring sealably slidable within the annular space between the tubular members intermediate the upper and intermediate sealing means to form an upper pressure chamber in the space on one end of said upper piston ring which is adapted to be filled with hydraulic fluid, and a lower piston ring sealably slidable with the annular space between the tubular members intermediate the lower and intermediate sealing means to form a lower pressure chamber in the space on one end of said lower piston ring which is also adapted to be filled with hydraulic fluid, with the outer tubular member having ports connecting the exterior thereof with the annular space on the other ends of the piston rings, whereby the pressure of hydraulic fluid in the chambers is equal to that outside of the jar.

The first tubular member has an upper cylindrical restriction in the upper chamber and a lower cylindrical restriction in the lower chamber, and upper detent means are carried by the second tubular member within the upper chamber for movement through the upper restriction so as to restrict the flow of hydraulic fluid within said chamber as the second tubular member is moved in one vertical direction with the pipe string, as well as lower detent means are carried by the second tubular member within the lower chamber so as to restrict the flow of hydraulic fluid within said chamber simultaneously with the restriction of flow in said upper chamber as the second tubular member is moved in said one vertical direction with the pipe string. More particularly, the detent means is of such construction as to permit relatively free flow simultaneously within the upper and lower chambers as the upper and lower detent means are moved vertically through the upper and lower restrictions, respectively, upon movement of the second tubular with the pipe string in said opposite vertical direction, and means are provided on the tubular members for engaging one another to impart a jar to the object as the upper and lower detent means are moved out of the restrictions, preferably in an upward direction to impart an up jar by pulling the pipe string to impart an upward jar to the fish. Thus, in accordance with the present invention, the fluid pressure in each chamber of the jar is essentially only 50% of what it would otherwise be, so that the load on the jar may be doubled without increasing the risk of damage.

As illustrated, the cylindrical restrictions are on the inner diameter of the outer member, and the detent ring means are carried by the inner member. As also illustrated, the detent means may be of more or less conventional construction for one way jars of this type. The drive section is, on the other hand, of relatively simple construction wherein the pins and slots as well as a pair of jar shoulders are contained in a single sealed chamber which protect the parts from contamination while at the same time minimizing the length of the jar.

Figure 2A:
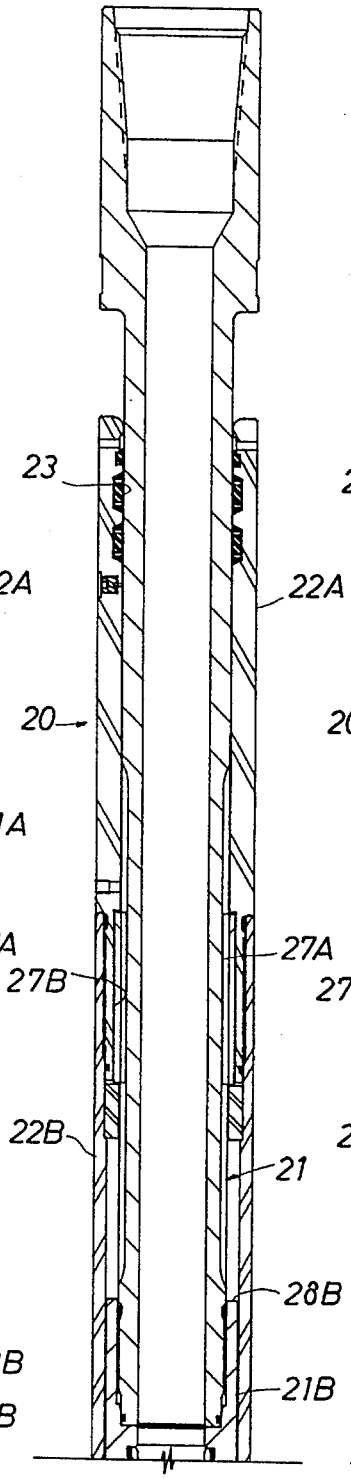
Figure 3A:
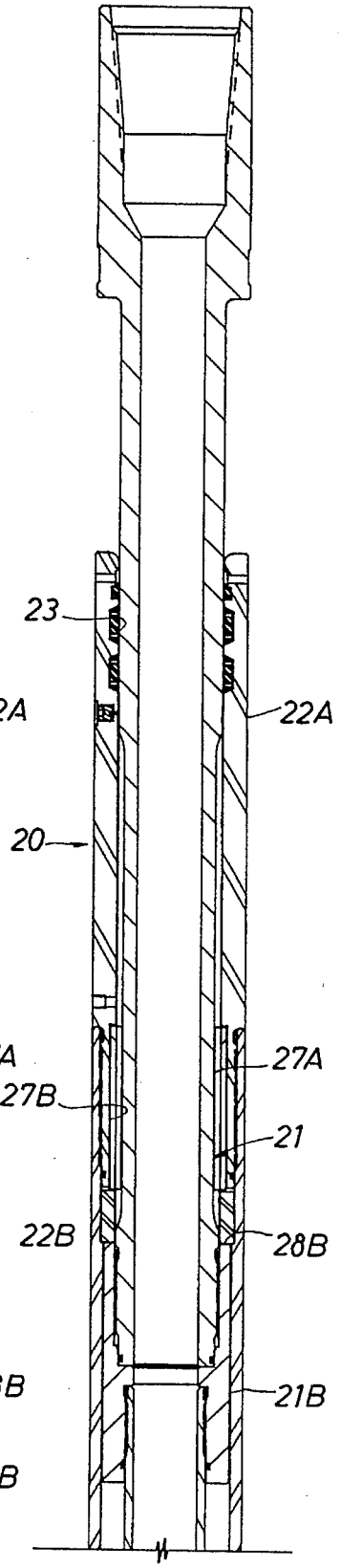
Figure 1B:
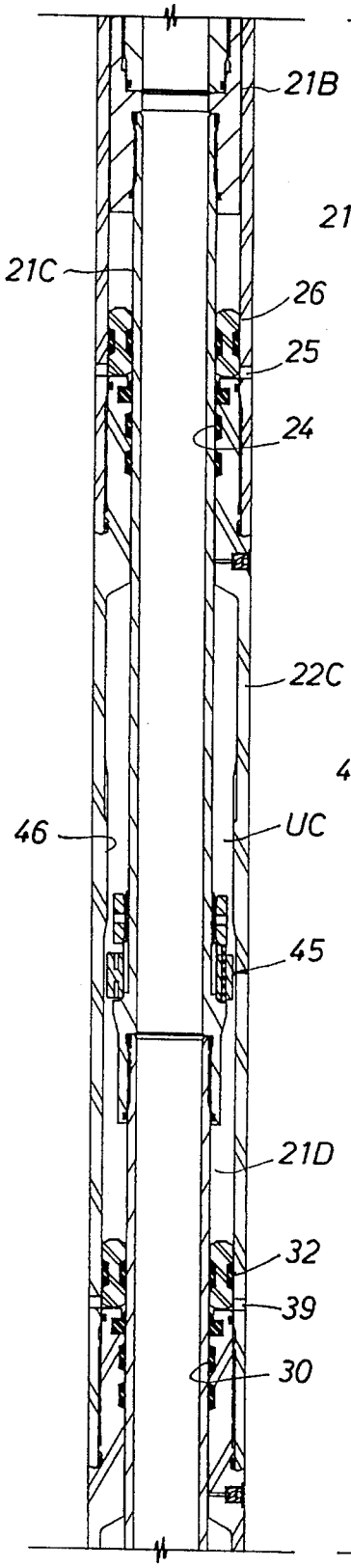
Figure 2B:
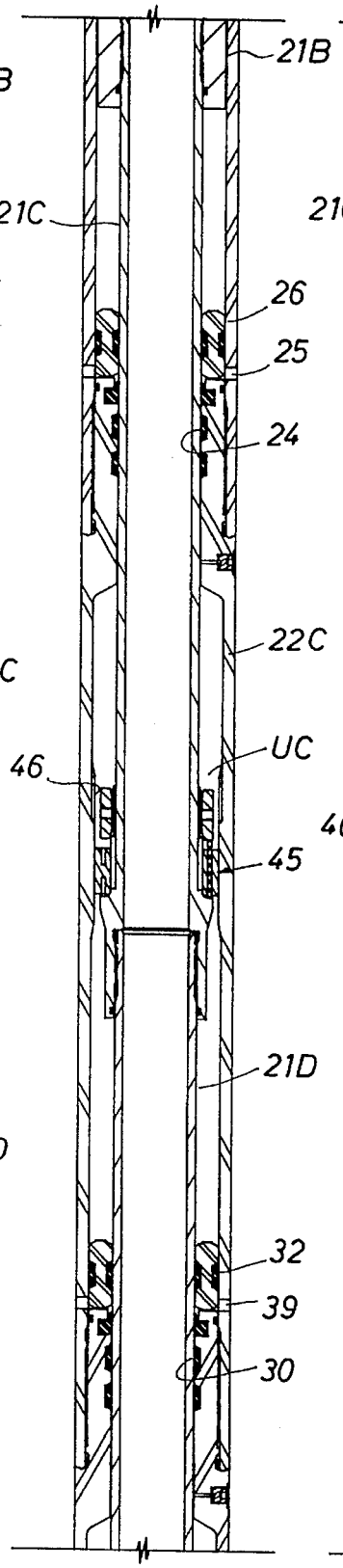
Figure 3B:
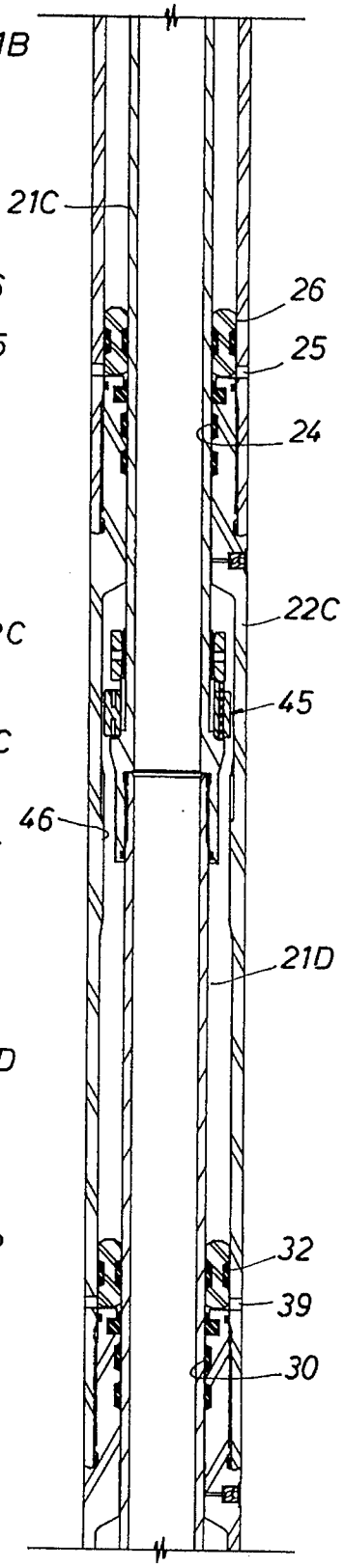
Figure 1C:
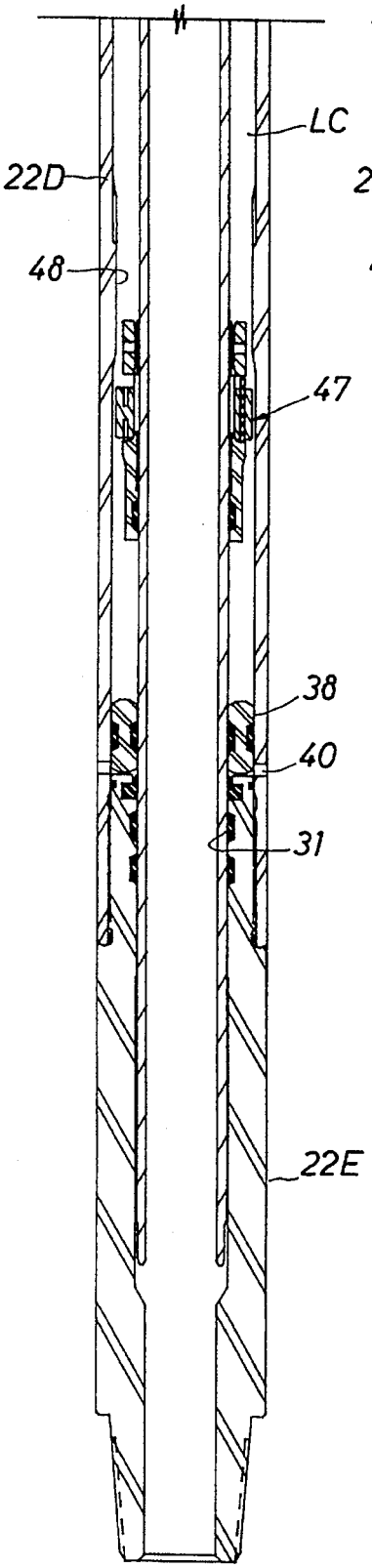
Figure 2C:
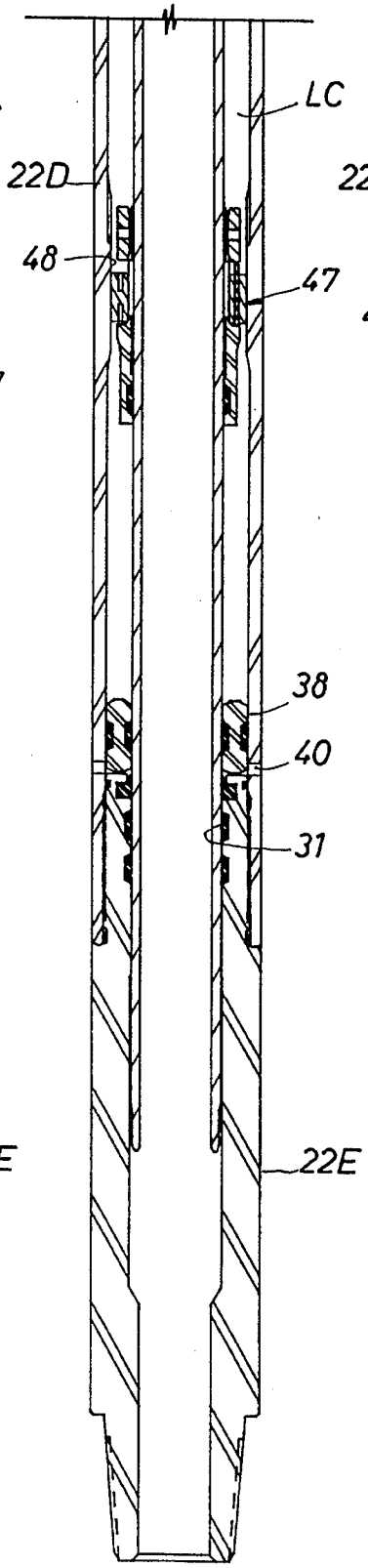
Figure 3C:
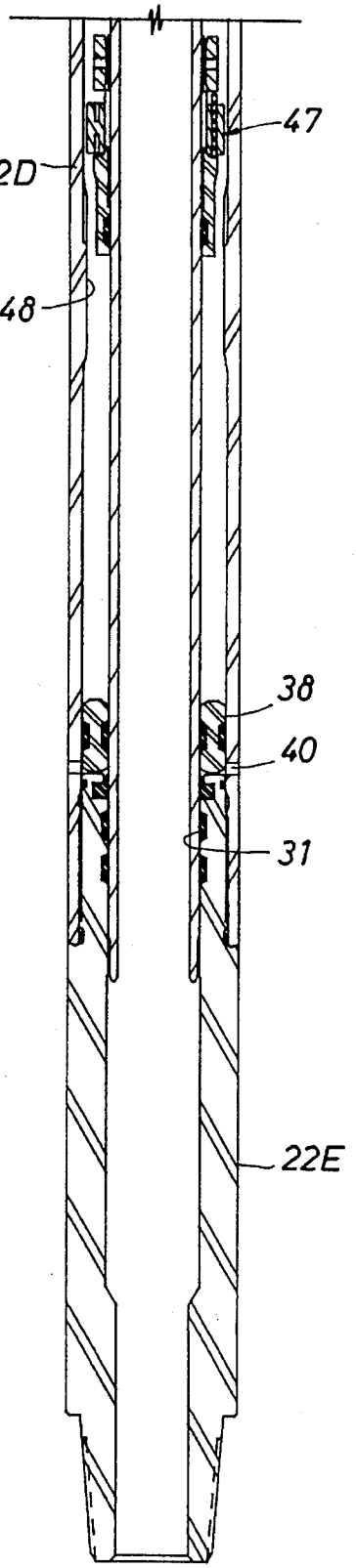

In the drawings, wherein like reference characters are used throughout to designate like parts:

FIGS. 1A, 1B, and 1C, are longitudinal sectional views of upper, intermediate and lower portions of the jar, with the upper and lower detent means disposed beneath the restriction in each of the upper and lower chambers preparatory to imparting an up jar;

FIGS. 2A, 2B, and 2C are similar views of the jar, but upon raising of detent means into the restrictions as the pipe string is pulled upwardly to initiate an up jar;

FIGS. 3A, 3B, and 3C are also longitudinal sectional views of the jar, similar to those of FIGS. 2A, 2B, and 2C, but with the detent means pulled upwardly out of the restrictions to permit shoulders of the tubular members to engage in order to impart an upward jar to the fish; and FIGS. 4 and 5 are enlarged vertical and cross-sectional views of the detent means, FIG. 5 being taken along broken lines 5—5 of FIG. 4.

With reference now to the details of the above described drawings, the overall jar, which is indicated in its entirety by reference character 20, comprises an upper drive and jar portion shown in FIGS. 1A, 2A and 3A, an upper detent portion shown in FIGS. 1B, 2B and 3B and a lower detent portion shown in FIGS. 1C, 2C and 3C, wherein each portion is made up of telescopically arranged, inner and outer tubular members 21 and 22, respectively, which form an annular space between them. The inner member 21 has a box at the upper end of the upper portion for connection to the lower end of a pipe string (not shown), and the outer member 22 has a pin at the lower end of the lower portion for connection to the box of a tubular object (not shown) stuck in the well bore, which may be a fish adapted to be jarred loose by operation of the jar in the manner to be described.

The inner tubular member includes an uppermost tubular section 21A on the upper end of which the box is formed, a coupling 21B connected to its lower end, and an intermediate tubular section 21C connected to the lower end of the coupling and extending downwardly from the drive and jar portion into the upper detent portion, as will be described to follow. The lower end of the intermediate tubular section 21C is in turn connected to a lowermost tubular section 21D extending downwardly through the lower detent portion.

The outer tubular member 22 includes an uppermost tubular section 22A surrounding the inner tubular section 21A and connected at its lower end to a tubular section 22B which surrounds coupling 21B and is in turn connected at its lower end to a tubular section 22C which surrounds the upper detent portion. The section 22C is in turn connected to a tubular section 22D which surrounds the lower detent portion and is connected at its lower end to a lower tubular section 22E surrounding the lower end of tubular section 21D of the inner tubular member and having the pin formed on its lower end.

As shown in FIGS. 1A, 2A and 3A, packings 23 about the inner diameter of the upper end of section 22A are slidably engaged with section 21A of the inner tubular member, and, as shown in FIG. 1B, 2B and 3B, packings 24 are carried about the inner diameter of section 22C to slidably engage the tubular section 21C. A piston 26 is sealably slidable within the annular space beneath coupling 21B and above the upper end of section 22C above packing 24, and ports 25 are formed in the outer tubular section 22B to connect the annular space between the inner and outer members beneath the piston with the exterior of the jar.

The annular space above piston 26 thus forms a closed chamber in which drive pins 27A carried by the outer tubular section are disposed within elongate slots 27B in the inner tubular section so as to impart torque from the pipe string and thus the outer tubular member to the lower tubular member regardless of their relative longitudinal positions. Oppositely facing shoulders 28A and 28B formed on the tubular members are also disposed in the chamber in position to be spaced from one another in the open position of the jar (FIGS. 1A, 1B and 1C) and engaged to transfer an upward jar to the tubular member and thus the fish, as the detent means are pulled upwardly with the jar, as shown in FIGS. 3A, 3B and 3C.

The piston 26 maintains this closed chamber at the pressure in the annulus outside of the jar, and since packings 23 and 24 are of the same sealing diameter, the tool is pressure balanced. Also, and as previously mentioned, the disposal of both the drive pins and slots and the jarring shoulders in the same chamber minimizes the length of the jar.

The upper jar shoulder 28A is formed on the lower end of a nut supported on an inner shoulder of tubular section 22B and is held in place on the shoulder by the lower end of tubular section 22A, and the lower jar shoulder 28B is formed on the upper end of coupling 21B. Piston 26 at the lower end of the chamber is reciprocable within the annular space and between the lower end of coupling 21B and upper end of tubular section 22C.

The annular space between the tubular members is divided into and an upper space between upper packing 24 and intermediate packing 30 carried by the upper portion of tubular section 22D, and a lower space between packing 30 carried by the upper portion of tubular section 22E and lower packing 31. The packings seal about equal diameters of the inner tubular member so that the chamber is pressure balanced.

An upper piston ring 37 is slidable within the upper annular space above the upper end of tubular section 22D to form an upper detent chamber UC between its upper end and packing 24, and a piston ring 38 is sealably slidable within the lower annular space above the upper end of tubular section 22E to form a lower detent chamber LC between it and packing 30. A port 39 is formed in the outer tubular member to connect the outside of the outer tubular member with the annular space below the piston ring 37 such that the pressure in the upper chamber UC is the same as that outside the tubular member. Similarly, a port 40 is formed in the outer tubular member intermediate the packing 31 and the lower side of the piston ring 38 so that the pressure in the lower pressure chamber LC is the same as that outside the jar. Each of the upper and lower chambers is filled with a hydraulic fluid which is essentially non-compressible.

Upper detent means 45 is carried about the tubular section 21C for disposal within the upper pressure chamber UC, and the inner diameter of the outer tubular section 22C has a reduced diameter restriction 46 formed therein through which the detent means 45 is adapted to move as the inner tubular member is raised or lowered. In like fashion, a lower detent means 47 is carried about the inner tubular member section 21D within the lower pressure chamber LC for movement through a reduced diameter restriction 48 in the outer tubular section 22D during reciprocation of the inner tubular member. As previously described, the detent means are so arranged on the tubular member that each moves through its restriction simultaneously with the other so that the jar is loaded uniformly. As also previously described, when the upper and lower detent means have been raised through their respective restrictions, as shown in FIGS. 3A–3C, the tension on the pipe string causes the upwardly facing jar shoulder 28B to move rapidly upwardly against the downwardly facing shoulder 28A so as to impart an upward jar to the fish.

Each of the detent means may be of conventional construction for use in imparting a one way jar, such as that shown and described in U.S. Pat. No. 4,226,289 (see FIGS. 5 and 8). Thus, as shown in FIG. 4, each may comprise a detent ring 50 carried about vertical slots 51 formed in the inner tubular member above an upwardly facing shoulder 52 thereon beneath a nut 53 surrounding the upper slotted portion of the inner tubular member.

The detent ring, whose outer diameter fits closely within a restriction formed on the inner diameter of the outer tubular member, is free to reciprocate between the shoulder 52 and the lower side of nut 53. However, as the inner tubular member is raised upwardly, it supports the detent ring 50 on its shoulder 52 so as to lift the ring through the restriction formed in the outer tubular member.

The ring has one or more holes 54 extending vertically therethrough each to receive a pin 55 which fits relatively closely therein. These pins thus meter flow through the holes as the detent ring is pulled upwardly through the restriction, thus restricting the overall flow of hydraulic fluid within the chamber in which the detent means is disposed. As shown, the metering pin is of somewhat lesser length than the vertical distance between the lower end of the nut 53 and the shoulder 52.

Upon imparting an upward jar, the inner tubular member may be moved downwardly through the restriction to its closed position shown in FIGS. 1A, 1B and 1C. For this purpose, the lower end of the nut 53 will engage the upper end of the pin and detent ring to move them downwardly through the restriction. During this downward movement, hydraulic fluid in the chamber is relatively free to flow past the detent ring through the slots 51.

From the foregoing it will be seen that this invention is one well adapted to attain all of the ends and objects hereinabove set forth, together with other advantages which are obvious and which are inherent to the apparatus.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. A hydraulic jar for use in applying a jar to an object stuck in a well bore, comprising first and second telescopically arranged tubular members connectible, respectively, to the stuck object and a pipe string adapted to be raised and lowered within the well bore and having an annular space between them, means sealing between upper, lower and intermediate equal diameter portions of the tubular members, an upper piston ring sealably slidable within the annular space between the tubular members vertically intermediate the upper and intermediate sealing means to form an upper pressure chamber in the annular space on one end of said upper piston ring which is adapted to be filled with hydraulic fluid, a lower piston ring sealably slidable with the annular space between the tubular members vertically intermediate the lower and intermediate sealing means to form a lower pressure chamber in the annular space on one end of said lower piston ring which is adapted to be filled with hydraulic fluid, the outer of the first and second tubular members having ports connecting the exterior thereof with the annular space on the other ends of the piston rings, the first tubular member having an upper cylindrical restriction in the upper pressure chamber and a lower cylindrical restriction in the lower pressure chamber, upper detent means carried by the second tubular member within the upper pressure chamber for movement through the upper restriction so as to restrict the flow of hydraulic fluid within said upper pressure chamber as the second tubular member is moved with the pipe string in one vertical direction with respect to the first tubular member and permit relatively free flow of such fluid within the upper pressure chamber as the second tubular member is moved with the pipe string in the opposite vertical direction with respect to the first tubular member, lower detent means carried by the second tubular member within the lower chamber so as to restrict the flow of hydraulic fluid within said lower pressure chamber simultaneously with the restriction of flow in said upper chamber as the second tubular member is moved with the pipe string in said one vertical direction with respect to the first tubular member and permit relatively free flow of such fluid within the lower pressure chamber simultaneously with the relatively free flow in said upper chamber as the second tubular member is moved with the pipe string in said opposite vertical direction with respect to said first tubular member, means on said tubular members for engaging one another to impart a jar to the object as the upper and lower detent means are moved in said one vertical direction out of the restrictions to impart a jar to the object as said upper and lower detent means are moved through the restrictions.

* * * * *